United States Patent [19]

Mahrus et al.

[11] Patent Number: 4,547,336

[45] Date of Patent: Oct. 15, 1985

[54] METHOD FOR THE MANUFACTURE OF PISTON RING INSERTS BY A POWDER METALLURGY TECHNIQUE

[75] Inventors: Duraid Mahrus; Luiz N. Benitez, both of Sao Paulo, Brazil

[73] Assignee: Meal Leve S.A. Industria e Comercio, Brazil

[21] Appl. No.: 455,481

[22] Filed: Jan. 4, 1983

[30] Foreign Application Priority Data

Jan. 11, 1982 [BR] Brazil ..... 18200106

[51] Int. Cl.[4] ..... B22F 3/00

[52] U.S. Cl. ..... 419/31; 419/36; 419/38; 75/246

[58] Field of Search ..... 419/31, 36, 38; 75/246

[56] References Cited

U.S. PATENT DOCUMENTS 2,164,198 3/1944 Clements et al. ..... 419/31

2,882,190 4/1959 Thompson et al. ..... 75/246

OTHER PUBLICATIONS

Hirschhoon, J. S.; *Introduction to Powder Metallurgy;* 1969, pp. 2 to 7.

*Primary Examiner*—Teddy S. Gron

*Assistant Examiner*—Anne Brookes

*Attorney, Agent, or Firm*—Darby & Darby

[57] ABSTRACT

A method for the manufacture of piston ring inserts by a powder metallurgy technique from austenitic ferrous alloys with an equivalent carbon content of more than 2%, said method comprising the following steps: melting a charge composed of an austenitic ferrous alloy having a total carbon content in excess of 2%; pouring the molten alloy and atomizing it by means of a stream of water, air or gas to produce powder of particle sizes ranging from +40 to −325 U.S. mesh, with an austenitic white cast iron structure and virtually no green resistance; annealing the particulate material in a reducing atomsphere; adding the annealed particulate material with a lubricant in such an amount that through a subsequent compacting operation of the particulate material to its final form same will present the highest green compact possible; burning off the lubricant in a protective atmosphere; sintering the compacted material and cooling it abruptly.

3 Claims, 2 Drawing Figures

METHOD FOR THE MANUFACTURE OF PISTON RING INSERTS BY A POWDER METALLURGY TECHNIQUE

The present invention relates to a method for the manufacture of ring inserts made by sintering austenitic ferro alloys having an equivalent carbon content of more than 2%, the said ring inserts being designed for use on aluminum alloy pistons for internal combustion engines.

It is already a common practice to provide pistons, particularly those for diesel engines, with at least one ring insert made of a material having a higher resistance than that of the piston. One well-known material for this purpose is an austenitic ferrous alloy designated Ni-resist.

Among the methods employed for making ring inserts the most well-known and extensively used consists in pouring a ferro-alloy having a high nickel content into a shell and molding a sleeve by centrifugation. Afterwards, the sleeve is machined and cut into annular sections from which the ring inserts are to be made. The material obtained by centrifugation of an austenitic ferro-alloy with an equivalent carbon content over 2% affords an austenitic gray cast iron of the types 1 thru 5. These gray irons show an austenitic matrix with the graphitic carbon appearing in the form of well-distributed flakes, as shown in FIG. 1 which illustrates the typical structure of a material cast from the said ferro-alloy. Also present are evenly distributed small complex chromium carbides $(FeCr_3)C$. This material is suitable for applications where a fair thermal and corrosion resistance is required. Furthermore, as compared with those aluminum based alloys commonly employed in the manufacture of pistons, the said cast material has appropriate mechanical and physical properties such as a thermal expansion coefficient close to that of the aluminum alloy, and good characteristics concerning hardness, machinability, wear resistance and tensile strength.

Despite the aforesaid advantages, there are certain applications where cast ring inserts are unable to meet in a fully satisfactory manner some special requirements of resistance to mechanical stresses such as those attending piston forging operations which is a method employed for making more resistant pistons. In such events, an increase of the customary nickel content could be provided thereby considerably increasing the strength of parts manufactured under the centrifugal method. However, the increase of Ni content combined with the cutting and machining operations of the sleeve and the material loss resulting therefrom would substantially increase cost of the final product.

OBJECTS OF THE INVENTION

It is therefore one object of the invention to provide a method for manufacturing ring inserts from austenitic ferrous alloys having an equivalent carbon content over 2% and possessing characteristics of hardness, tensile strength and resistance to wear, elongation and linear thermal expansion coefficient better than those of the same material accomplished by the centrifugation method.

It is a particular object of the invention to provide a method for the manufacture of ring inserts from austenitic ferrous alloys with an equivalent carbon content of more than 2%, for application on aluminum based alloy pistons, which obviate the need for machining operations prior to application to the piston and have better mechanical properties than those of the same material accomplished by the centrifugation method.

It is a further object of the invention to provide a method of manufacturing ring inserts from said alloys showing an austenitic matrix with the graphite evenly distributed in a vermicular shape, as illustrated in FIG. 2.

These and other objects and advantages of the invention are attained by means of a powder metallurgy technique as hereinafter described with reference to the accompanying drawings where:

SUMMARY OF THE INVENTION

Figure 1:
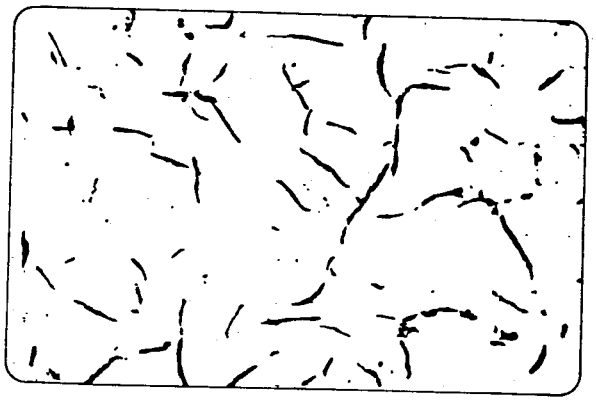
FIG. 1 illustrates a typical structure resulting from the centrifugation of a standard Ni-resist alloy, showing the graphite in the shape of flakes in the austenitic matrix.
Figure 2:
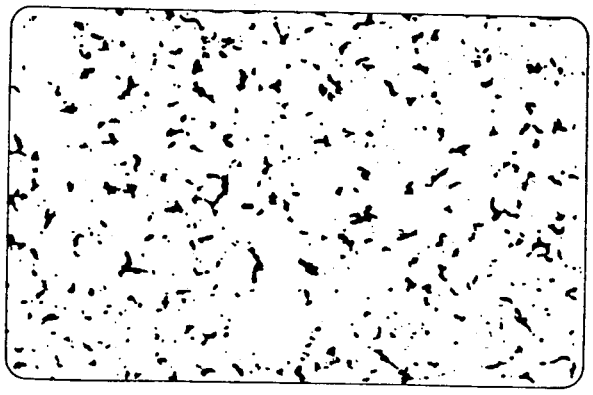
FIG. 2 illustrates the structure resulting from a water-atomized standard Ni-resist material, showing an even distribution of vermicular graphite in the austenitic matrix.

A method for the manufacture of ring inserts from austenitic ferrous alloys, said alloys containing an equivalent carbon content of more than 2%, said method using powder metallurgy techniques and comprising the steps of: melting in a furnace a charge of an austenitic ferrous alloy having a total equivalent carbon content of more than 2%; pouring the molten alloy and atomizing it by means of a stream of water, air or gas, for producing powder having grain size ranging from +40 to −325 U.S. mesh, an austenitic white cast iron structure and virtually no green resistance; annealing the particulate material in a reducing atmosphere; adding a lubricant to the annealed particulate material in an amount such that upon subsequent compacting of the particulate material to its final form said material will present the highest green compact possible; compacting said material to its final form; burning off the lubricant in a protective atmosphere; sintering the compacted material and cooling it down abruptly.

DETAILED DESCRIPTION OF THE INVENTION

The first step consists in preparing a charge of an austenitic ferrous alloy containing an equivalent content of over 2% carbon, which charge components are within the following range in weight percentage: 2.5–4.0% of C, 1.0–3.0% of Cr, 11.0–25.0% of Ni, 1.0–9.0% of Mn, 1.0–4.0% of Si, 1.0–8.0% of Cu and the balance of Fe. Definition of the amount of the alloy constituents is a function of the means to be employed to carry out the automization, i.e., air, water or gas.

The charge thus selected is introduced into a melting furnace and heated up to a suitable temperature (approximately 1500° C.) thereby causing the alloy to melt. Thereafter, the material is atomized by means of any known method such as air, water or gas, either with or without a protective atmosphere, thus producing powder having different grain sizes ranging from +40 to −325 U.S. mesh. The particles obtained by any of the customary atomization methods show a structure of austenitic white cast iron with a hardness of 520 in Vicker's scale (approximately 50 Rockwell C) and virtually no green resistance. Therefore, prior to compaction the material must be subjected to annealing in a reducing atmosphere whereby particles having a hardness of approximately 220 in Brinnel scale are obtained. The heat treated particles are added with a 3.0 to 3.5% in weight of a lubricant such as zinc stearate or paraffin designed to impart by means of a subsequent compaction the highest possible green compact.

During tests conducted, the particles with 1% of lubricant (zinc stearate or paraffin) were subjected to different compaction pressures which resulted in a green compact ranging from 4 to 7 g/cm$^3$.

Subsequent to compaction the lubricant is burned off in a protective atmosphere and thereafter the compacted material is sintered in a furnace for 30 minutes, with the sintering temperature ranging from 900° to 1200° C. After the sintering operation the material is cooled down abruptly so as to increase the carbon solubility within the austenite thereby improving its mechanical properties.

Tests conducted with the material obtained under the method as herein described have presented the results shown in the table below:

| | Casting | Sintering |
|---|---|---|
| Max. tensile strength | 17.5–21.0 kg/mm$^2$ | 34.0–38.0 kg/mm$^2$ |
| Hardness | 130–160 kg/mm$^2$ HBN | 120–150 kg/mm$^2$ HBN |
| Elongation | 1% | 3–6% |
| Coefficient of Linear Thermal Expansion | $18 \times 10^{-60}$ C$^{-1}$ | $21 \times 10^{-60}$ C$^{-1}$ |

It is thus apparent from the above values that the properties of the sintered material are substantially better than those of a similar material obtained by the centrifugation process.

According to the description and values shown in the table and accompanying drawings the ring insert made of sintered austenitic ferro-alloys for use on aluminum based alloy pistons for internal combusion engines offers the following advantages: (a) a higher degree of resistance to mechanical stresses which renders the insert highly suitable for the manufacture of forged pistons, in which method higher stresses take place; (b) when the ring insert is embedded in the piston by intermetallic bonding, the closeness of thermal expansion coefficient of the piston material (al) to that of the ring insert material (Fe) provides a minimization of solidification stresses of the piston material.

What is claimed is:

1. A piston ring insert made from an austenitic ferrous alloy, wherein said ring insert is manufactured by a powder-metallurgy method comprising:

melting in a furnace a charge of said austenitic ferrous alloy; the constituents of said alloy charge comprising in weight percentage: 2.5–4.0% of C, 1.0–3.0% of Cr, 11.0–25.0% of Ni, 1.0–9.0% of Mn, 1.0–4.0% of Si, 1.0–8.0% of Cu and the balance of Fe;

pouring the molten alloy and atomizing it by means of a stream of water, air or gas, for producing powder having grain size ranging from +40 to −325 U.S. mesh, an austenitic white cast iron structure and virtually no green resistance;

annealing the particulate material in a reducing atmosphere;

adding a lubricant to the annealed particulate material in an amount such that upon subsequent compacting of the particulate material to its final form said material will present the highest green density possible;

compacting said material to its final form;

burning off the lubricant in a protective atmosphere;

sintering the compacted material and cooling it down rapidly so as to increase carbon solubility within the austenitic alloy thereby improving the mechanical properties of said material; whereby said insert has higher stress resistance than ring inserts of the same alloy produced without use of powder metallurgy.

2. Ring insert according to claim 1, wherein the sintering step is performed in a furnace for approximately 30 minutes at a sintering temperature from 900° to 1200° C.

3. Ring insert according to claim 1, wherein the lubricant is zinc stearate or paraffin in an amount of 0.3 to 3.5%.

* * * * *